US010365594B2

(12) United States Patent
Cao

(10) Patent No.: US 10,365,594 B2
(45) Date of Patent: Jul. 30, 2019

(54) SYSTEM AND METHOD FOR CONTROLLING A FUSER ASSEMBLY OF AN ELECTROPHOTOGRAPHIC IMAGING DEVICE

(71) Applicant: Lexmark International, Inc., Lexington, KY (US)

(72) Inventor: Jichang Cao, Lexington, KY (US)

(73) Assignee: LEXMARK INTERNATIONAL, INC., Lexington, KY (US)

( * ) Notice: Subject to any disclaimer, the term of this patent is extended or adjusted under 35 U.S.C. 154(b) by 0 days.

(21) Appl. No.: 15/989,537

(22) Filed: May 25, 2018

(65) Prior Publication Data

US 2018/0275570 A1 Sep. 27, 2018

Related U.S. Application Data

(63) Continuation of application No. 15/813,500, filed on Nov. 15, 2017, now Pat. No. 10,061,237, which is a continuation of application No. 15/262,860, filed on Sep. 12, 2016, now abandoned.

(51) Int. Cl.
*G03G 15/20* (2006.01)
*G03G 15/00* (2006.01)

(52) U.S. Cl.
CPC ..... *G03G 15/2039* (2013.01); *G03G 15/80* (2013.01); *G03G 2215/2035* (2013.01)

(58) Field of Classification Search
CPC ..... G03G 15/2039; G03G 15/2042; G03G 15/80; G03G 2215/2035
See application file for complete search history.

(56) References Cited

U.S. PATENT DOCUMENTS 9,298,141 B2 * 3/2016 Itoh ..... G03G 15/2039
2015/0086231 A1 * 3/2015 Bush ..... G03G 15/2042 399/69

* cited by examiner

*Primary Examiner* — Sophia A Chen

(57) ABSTRACT

An apparatus includes a fuser assembly including a heater member. The heater member includes at least one heating element and at least one temperature sensor to sense a temperature of the heating element. A first power control unit is coupled to the at least one temperature sensor and operative to calculate at least one power level for the at least one heating element based upon at least one set-point temperature therefor and the temperature sensed by the at least one temperature sensor. A second power control unit is coupled to the first power control unit, receives the calculated at least one power level and selects, based upon the calculated power level, at least one actual power level from a stored plurality of predetermined power levels. The second power control unit controls a power for the at least one heating element based upon the selected at least one actual power level.

20 Claims, 9 Drawing Sheets

0% Actual Power level where:
P1 = 500 W
P2 = 1000 W
P3 = 1500 W

25% Actual Power level

50% Actual Power level

75% Actual Power Level

100% Actual Power Level

SYSTEM AND METHOD FOR CONTROLLING A FUSER ASSEMBLY OF AN ELECTROPHOTOGRAPHIC IMAGING DEVICE

CROSS REFERENCES TO RELATED APPLICATIONS

This application claims priority as a continuation application of U.S. patent application Ser. No. 15/813,500, filed Nov. 15, 2017, which claims priority as a continuation application of U.S. patent application Ser. No. 15/262,860, filed Sep. 12, 2016, each having the same title.

STATEMENT REGARDING FEDERALLY SPONSORED RESEARCH OR DEVELOPMENT

None.

REFERENCE TO SEQUENTIAL LISTING, ETC.

None.

BACKGROUND

1. Field of the Disclosure

The present disclosure relates generally to controlling a fuser assembly in an electrophotographic imaging device, and particularly to controlling power levels in the fuser assembly to reduce flicker and harmonics.

2. Description of the Related Art

In an electrophotographic (EP) imaging process used in laser printers, copiers and the like, a photosensitive member, such as a photoconductive drum or belt, is uniformly charged over an outer surface. An electrostatic latent image is formed by selectively exposing the uniformly charged surface of the photosensitive member. Toner particles are applied to the electrostatic latent image, and thereafter the toner image is transferred to a media sheet intended to receive the final image. The toner image is fixed to the media sheet by the application of heat and pressure in a fuser assembly. The fuser assembly may include a heated roll and a backup roll forming a fuser nip through which the media sheet passes. Alternatively, the fuser assembly may include a fuser belt, a heater disposed within the belt around which the belt rotates, and an opposing backup member, such as a backup roll.

Imaging devices typically draw power from an electrical power grid, i.e., the AC (alternating current) mains, in order to operate. During a fusing operation, the fuser assembly draws relatively large amounts of power to heat the fuser which may cause large voltage variations which, in turn, may generate severe harmonics and noticeable flicker. In most geographical locations, strict flicker and harmonics requirements are set to reduce their undesirable effect on health and other sensitive electronic/electrical equipment. As a result, manufacturers of imaging devices are continuingly challenged to reduce harmonics and flicker generated during fusing operations while not compromising temperature control performance.

SUMMARY

Embodiments of the present disclosure provide systems and methods for controlling a heater of a fuser assembly in an image forming device to reduce flicker and harmonics.

In one example embodiment, an apparatus includes a fuser assembly including a heater member and a backup member positioned to engage the heater member to form a fusing nip therewith. The heater member includes at least one heating element and at least one temperature sensor positioned to sense a temperature of the heating element. A first power control unit is coupled to the at least one temperature sensor of the fuser assembly and is operative to calculate at least one power level for the at least one heating element based upon at least one set-point temperature therefor and the temperature sensed by the at least one temperature sensor. A second power control unit is coupled to an output of the first power control unit. The second power control unit receives the calculated at least one power level and selects, based upon the calculated at least one power level, at least one actual power level from a stored plurality of predetermined power levels. The second power control unit controls an amount of power for the at least one heating element based upon the selected at least one actual power level.

In an example embodiment, the second power control unit includes a power mapping function that maps the calculated at least one power level to the at least one actual power level. The power mapping function defines a first group of one or more actual power levels and a second group of one or more actual power levels with the first group of one or more actual power levels causing less flicker when used to control the amount of power for the at least one heating element relative to an amount of flicker generated when the second group of one or more actual power levels are used to control the amount of power for the at least one heating element. The first group of one or more actual power levels have mapping domains that are larger than mapping domains of the second group of one or more actual power levels such that the first group of one or more actual power levels have a higher probability of being selected than the second group of one or more actual power levels during the fusing operation.

In another example embodiment, an apparatus includes a fuser assembly including a heater member and a backup member positioned to engage the heater member to form a fusing nip therewith. The heater member includes a first heating element and a second heating element, and a first temperature sensor positioned to sense a temperature of the first heating element and a second temperature sensor positioned to sense a temperature of the second heating element. A first power control unit is coupled to the fuser assembly calculates a first power level for the first heating element based upon a set-point temperature therefor and the temperature sensed by the first temperature sensor, and calculates a second power level for the second heating element based upon a set-point temperature therefor and the temperature sensed by the second temperature sensor. A second power control unit is coupled to an output of the first power control unit. The second power control unit receives the calculated first power level and selects, based upon the calculated first power level, a first predetermined half-cycle waveform pattern to be used for powering the first heating element. The second power control unit also receives the calculated second power level and selects, based upon the calculated second power level, a second predetermined half-cycle waveform pattern to be used for powering the second heating element. The second power control unit independently controls an amount of power for the first and second heating elements relative to each other during a fusing operation.

In an example embodiment, the second power control unit selects the first and second predetermined half-cycle waveform patterns from a plurality of predetermined half-cycle waveform patterns based upon the calculated first and second power levels, respectively. The second power control unit includes a mapping function that maps the calculated first power level to a first actual power level for powering the first heating element and maps the calculated second power level to a second actual power level for powering the second heating element. The second power control unit selects the first predetermined half-cycle waveform pattern based upon the first actual power level and selects the second predetermined half-cycle waveform pattern based upon the second actual power level. The mapping function defines a weighted mapping scheme in which one or more actual power levels have mapping domains that are larger than mapping domains of other actual power levels, the one or more actual power levels with the larger mapping domains causing less flicker when used for powering the first and second heating elements relative to an amount of flicker generated by the first and second heating elements when the other actual power levels are used for powering the first and second heating elements.

In another example embodiment, a method of controlling a fuser in an imaging apparatus during a fusing operation, the fuser including a heater member having a first heating element and a second heating element running parallel to each other relative to a fuser nip of the fuser, includes detecting a first temperature of the first heating element and a second temperature of the second heating element, and calculating a first power level for the first heating element based upon a set-point temperature therefor and the first temperature, and a second power level for the second heating element based upon a set-point temperature therefor and the second temperature. The method further includes selecting a first actual power level and a second actual power level from a stored plurality of predetermined power levels based upon the calculated first and second power levels, respectively, and controlling an amount of power for each the first and second heating elements during the fusing operation based upon the selected first and second actual power levels, respectively.

BRIEF DESCRIPTION OF THE DRAWINGS

The above-mentioned and other features and advantages of the disclosed example embodiments, and the manner of attaining them, will become more apparent and will be better understood by reference to the following description of the disclosed example embodiments in conjunction with the accompanying drawings, wherein.

DETAILED DESCRIPTION

Figure 1:
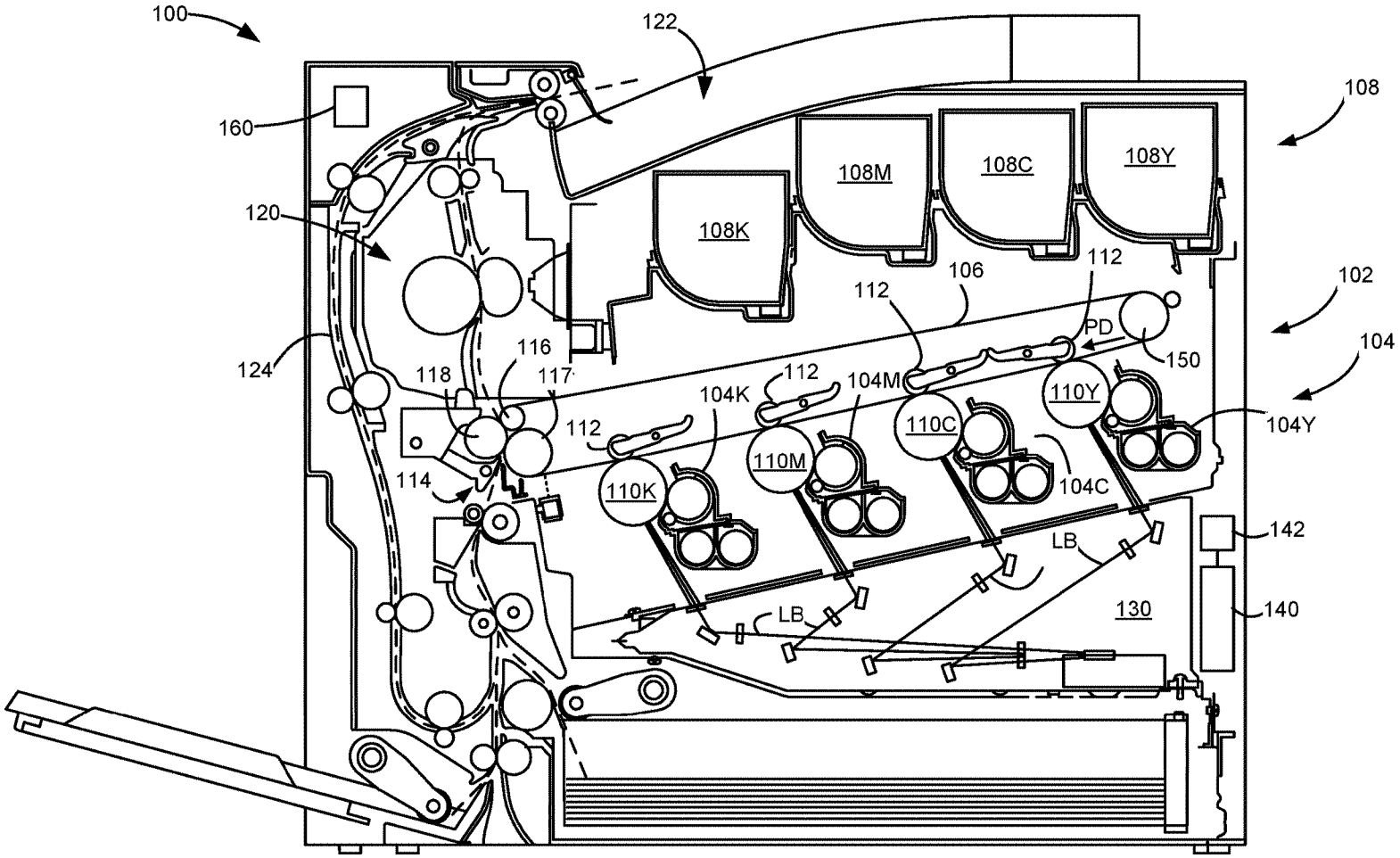
FIG. 1 is a schematic illustration of an imaging device including a fuser assembly according to an example embodiment.

It is to be understood that the present disclosure is not limited in its application to the details of construction and the arrangement of components set forth in the following description or illustrated in the drawings. The present disclosure is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings. Terms such as "first", "second", and the like, are used to describe various elements, regions, sections, etc. and are not intended to be limiting. Further, the terms "a" and "an" herein do not denote a limitation of quantity, but rather denote the presence of at least one of the referenced item.

Furthermore, and as described in subsequent paragraphs, the specific configurations illustrated in the drawings are intended to exemplify embodiments of the disclosure and that other alternative configurations are possible.

Reference will now be made in detail to the example embodiments, as illustrated in the accompanying drawings. Whenever possible, the same reference numerals will be used throughout the drawings to refer to the same or like parts.

FIG. 1 illustrates a color imaging device 100 according to an example embodiment. Imaging device 100 includes a first toner transfer area 102 having four developer units 104Y, 104C, 104M and 104K that substantially extend from one end of imaging device 100 to an opposed end thereof. Developer units 104 are disposed along an intermediate transfer member (ITM) 106. Each developer unit 104 holds a different color toner. The developer units 104 may be aligned in order relative to a process direction PD of the ITM belt 106, with the yellow developer unit 104Y being the most upstream, followed by cyan developer unit 104C, magenta developer unit 104M, and black developer unit 104K being the most downstream along ITM belt 106.

Each developer unit 104 is operably connected to a toner reservoir 108 for receiving toner for use in a printing operation. Each toner reservoir 108Y, 108C, 108M and 108K is controlled to supply toner as needed to its corresponding developer unit 104. Each developer unit 104 is associated with a photoconductive member 110Y, 110C, 110M and 110K that receives toner therefrom during toner development in order to form a toned image thereon. Each photoconductive member 110 is paired with a transfer member 112 for use in transferring toner to ITM belt 106 at first transfer area 102.

During color image formation, the surface of each photoconductive member 110 is charged to a specified voltage, such as −800 volts, for example. At least one laser beam LB from a printhead or laser scanning unit (LSU) 130 is directed to the surface of each photoconductive member 110 and discharges those areas it contacts to form a latent image thereon. In one embodiment, areas on the photoconductive member 110 illuminated by the laser beam LB are discharged to approximately −100 volts. The developer unit 104 then transfers toner to photoconductive member 110 to form a toner image thereon. The toner is attracted to the areas of the surface of photoconductive member 110 that are discharged by the laser beam LB from LSU 130.

ITM belt 106 is disposed adjacent to each of developer unit 104. In this embodiment, ITM belt 106 is formed as an endless belt disposed about a backup roll 116, a drive roll 117 and a tension roll 150. During image forming or imaging operations, ITM belt 106 moves past photoconductive members 110 in process direction PD as viewed in FIG. 1. One or more of photoconductive members 110 applies its toner image in its respective color to ITM belt 106. For monocolor images, a toner image is applied from a single photoconductive member 110K. For multi-color images, toner images are applied from two or more photoconductive members 110. In one embodiment, a positive voltage field formed in part by transfer member 112 attracts the toner image from the associated photoconductive member 110 to the surface of moving ITM belt 106.

ITM belt 106 rotates and collects the one or more toner images from the one or more developer units 104 and then conveys the one or more toner images to a media sheet at a second transfer area 114. Second transfer area 114 includes a second transfer nip formed between back-up roll 116, drive roll 117 and a second transfer roller 118. Tension roll 150 is disposed at an opposite end of ITM belt 106 and provides suitable tension thereto.

Fuser assembly 120 is disposed downstream of second transfer area 114 and receives media sheets with the unfused toner images superposed thereon. In general terms, fuser assembly 120 applies heat and pressure to the media sheets in order to fuse toner thereto. After leaving fuser assembly 120, a media sheet is either deposited into an output media area 122 or enters a duplex media path 124 for transport to second transfer area 114 for imaging on a second surface of the media sheet.

Imaging device 100 is depicted in FIG. 1 as a color laser printer in which toner is transferred to a media sheet in a two-step operation. Alternatively, imaging device 100 may be a color laser printer in which toner is transferred to a media sheet in a single-step process—from photoconductive members 110 directly to a media sheet. In another alternative embodiment, imaging device 100 may be a monochrome laser printer which utilizes only a single developer unit 104 and photoconductive member 110 for depositing black toner directly to media sheets. Further, imaging device 100 may be part of a multi-function product having, among other things, an image scanner for scanning printed sheets.

Imaging device 100 further includes a controller 140 and memory 142 communicatively coupled thereto. Though not shown in FIG. 1, controller 140 may be coupled to components and modules in imaging device 100 for controlling same. For instance, controller 140 may be coupled to toner reservoirs 108, developer units 104, photoconductive members 110, fuser assembly 120 and/or LSU 130 as well as to motors (not shown) for imparting motion thereto. It is understood that controller 140 may be implemented as any number of controllers and/or processors for suitably controlling imaging device 100 to perform, among other functions, printing operations.

Still further, imaging device 100 includes a power supply 160. In one example embodiment, power supply 160 includes a low voltage power supply which provides power to many of the components and modules of imaging device 100 and a high voltage power supply for providing a high supply voltage to modules and components requiring higher voltages.

Figure 2:
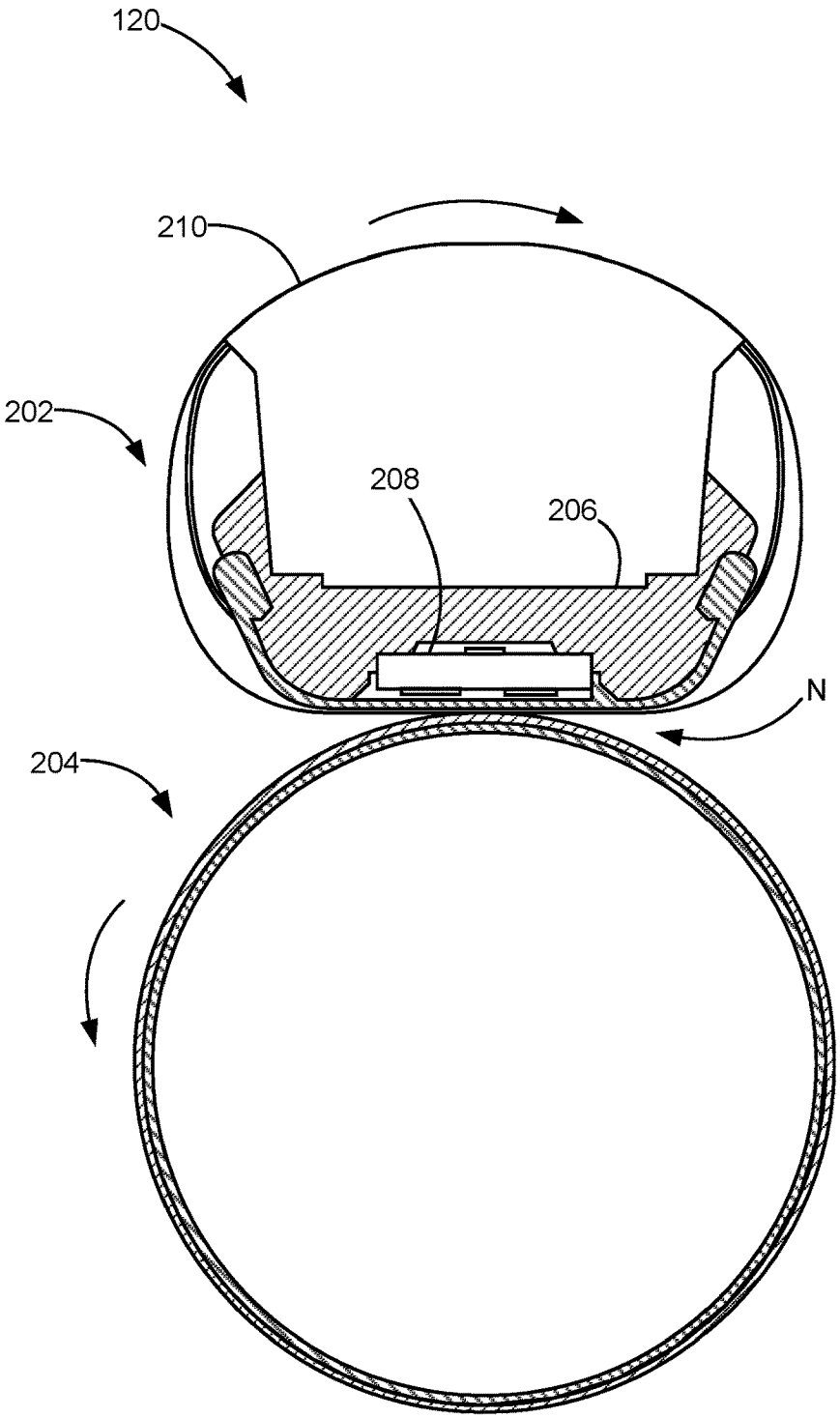
FIG. 2 is a cross sectional view of the fuser assembly in FIG. 1.

With respect to FIG. 2, in accordance with an example embodiment, there is shown fuser assembly 120 for use in fusing toner to sheets of media through application of heat and pressure. Fuser assembly 120 may include a heat transfer member 202 and a backup roll 204 cooperating with the heat transfer member 202 to define a fuser nip N for conveying media sheets therein. The heat transfer member 202 may include a housing 206, a heater member 208 supported on or at least partially in housing 206, and an endless flexible fuser belt 210 positioned about housing 206. Heater member 208 may be formed from a substrate of ceramic or like material to which at least one resistive trace is secured which generates heat when a current is passed through it. Heater member 208 may be constructed from the elements and in the manner as disclosed in U.S. patent application Ser. No. 14/866,278, filed Sep. 25, 2015, and assigned to the assignee of the present application, the content of which is incorporated by reference herein in its entirety. The inner surface of fuser belt 210 contacts the outer surface of heater member 208 so that heat generated by heater member 208 heats fuser belt 210. It is understood that, alternatively, heater member 208 may be implemented using other heat-generating mechanisms.

Fuser belt 210 is disposed around housing 206 and heater member 208. Backup roll 204 contacts fuser belt 210 such that fuser belt 210 rotates about housing 206 and heater member 208 in response to backup roll 204 rotating. With fuser belt 210 rotating around housing 206 and heater member 208, the inner surface of fuser belt 210 contacts heater member 208 so as to heat fuser belt 210 to a temperature sufficient to perform a fusing operation to fuse toner to sheets of media.

Fuser belt 210 and backup roll 204 may be constructed from the elements and in the manner as disclosed in U.S. Pat. No. 7,235,761, which is assigned to the assignee of the present application and the content of which is incorporated by reference herein in its entirety. It is understood, though, that fuser assembly 120 may have a different fuser belt architecture or even a different architecture from a fuser belt based architecture. For example, fuser assembly 120 may be a hot roll fuser, including a heated roll and a backup roll engaged therewith to form a fuser nip through which media sheets traverse. The hot roll fuser may include an internal or external heater member for heating the heated hot roll. The hot roll fuser may further include a backup belt assembly. Hot roll fusers, with internal and external heating forming the heat transfer member with the hot roll, and with or without backup belt assemblies, are known in the art and will not be discussed further for reasons of expediency.

Figure 3:
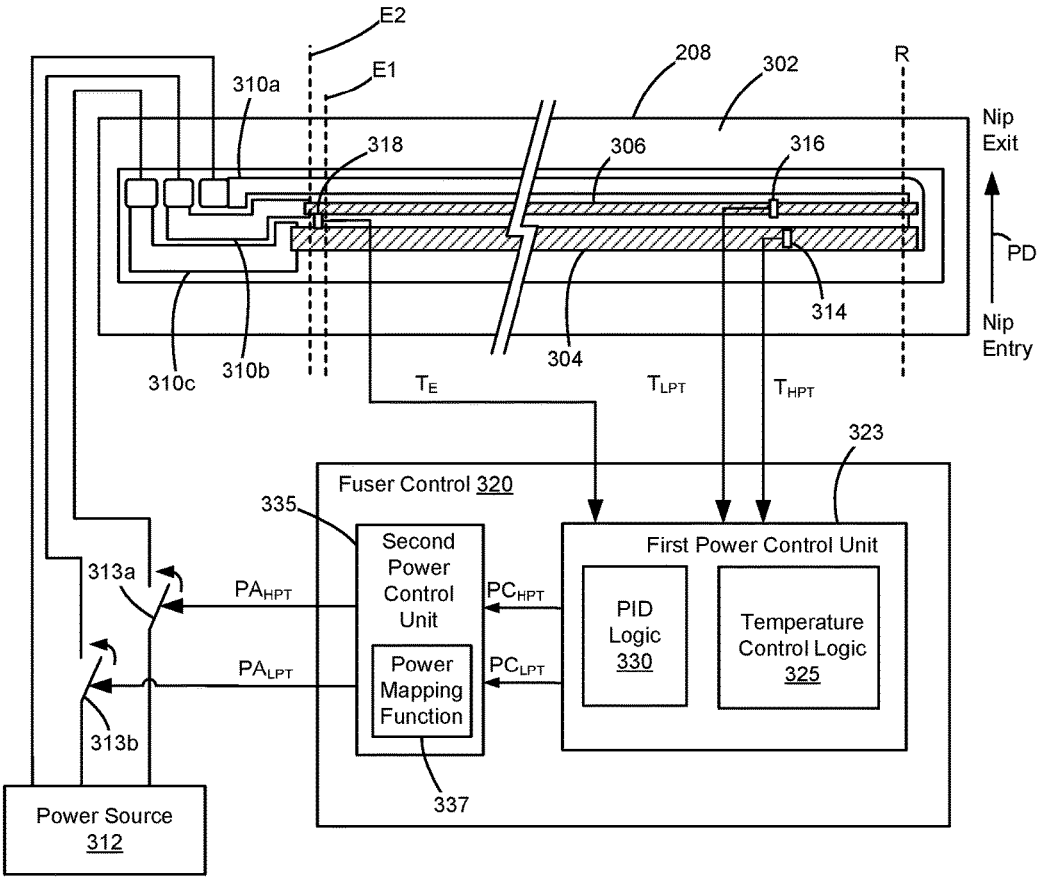
FIG. 3 is an illustrative view a heater member of the fuser assembly in FIG. 2 according to an example embodiment.

Referring now to FIG. 3, a fuser configuration is illustrated according to an example embodiment. In the example shown, heater member 208 is configured for a reference-edge based media feed system in which the media sheets are aligned in the media feed path of imaging device 100 using a side edge of each sheet. Heater member 208 includes a substrate 302 constructed from ceramic or other like material. Disposed on a bottom surface of substrate 302 in parallel relation with each other are two resistive traces 304 and 306. Resistive trace 304 is disposed on the entry side of fuser nip N and resistive trace 306 is disposed on the exit side of fuser nip N so that the process direction PD of fuser assembly 120 is illustrated in FIG. 3. Resistive traces 304, 306 are capable of generating heat when provided with electrical power. Heater member 208 further includes a plurality of conductors 310*a*, 310*b*, 310*c* connected to resistive traces 304, 306 to provide paths for current from a power source 312 to pass through resistive traces 304, 306. Power source 312 may form part of or draw power from one or more power supplies in imaging device 100, such as power supply 160. Power source 312 may include additional circuitries that are used to convert signals into forms suitable for use by fuser assembly 120.

In the example embodiment illustrated, resistive trace 304 has a length that is longer than a length of resistive trace 306. In an example embodiment, the length of resistive trace 304 is comparable to the width of a Letter sized sheet of media and is disposed on substrate 302 for fusing toner to Letter sized sheets. The length of resistive trace 306 is comparable to the width of A4 sized sheet of media and is disposed on substrate 302 for fusing toner to A4 sized sheets.

In an example embodiment, the width of resistive trace 304 is larger than the width of resistive trace 306 in order to have different heating zone requirements for different print speeds. In an example embodiment, the width of resistive trace 304 is between about 4.5 mm and about 5.5 mm, such as 5 mm, and the width of resistive trace 306 is between about 2.0 mm and about 2.50 mm, such as 2.25 mm. In general terms, the width of resistive trace 304 is between about two and about three times the width of resistive trace 306. By having such a difference in trace widths, and with the resistivity of resistive trace 304 being substantially the same as the resistivity of resistive trace 304 such that the resistance of trace 304 is less than the resistance of trace 306, resistive trace 304 may be used for lower printing speeds and both resistive traces 304 and 306 may be used for relatively high printing speeds.

In an example embodiment, resistive traces 304, 306 have different power ratings. In an example embodiment, resistive trace 304, hereinafter referred to as high power trace (HPT) 304, has a power level of about 1000 W and resistive trace 306, hereinafter referred to as low power trace (LPT) 306, has a power level of about 500 W. A fuser control block 320 controls power source 312 to control the current passing through, and hence the power level of, each resistive trace 304 and 306. Fuser control block 320 may be implemented in controller 140 and employ one or more fuser control methods such as proportional-integral-derivative (PID) control to control heat generation by heater member 208. Alternatively, fuser control block 320 may be provided separately from controller 140. In an example embodiment, resistive traces 304, 306 are controlled independently from one another by fuser control block 320.

Fusing temperature for fusing media sheets may be controlled by measuring the temperature of one or more regions of substrate 302 using a plurality of temperature sensors held in contact therewith and feeding the temperature information to fuser control block 320 which in turn controls the amount of power from power source 312 that is delivered to heater member 208 based on the temperature information. In the example shown, a plurality of thermistors including a first thermistor 314 is disposed on a top surface of substrate 302 opposite an area of resistive trace 304 near the length-wise end of resistive trace 304 that corresponds to the reference edge R of a sheet of media passing through fuser nip N. First thermistor 314 is used for sensing the temperature of the substrate region that is directly heated by high power trace 304 and controlling the amount of heat generated thereby. Similarly, a second thermistor 316 is disposed on the top surface of substrate 302 opposite resistive trace 306 near the length-wise end of resistive trace 306 that corresponds to the reference edge R of the sheet of media. Second thermistor 316 is used for sensing the temperature of the substrate region directly heated by low power trace 306 and controlling the amount of heat generated thereby.

A third thermistor, edge thermistor 318, is disposed on the top surface of substrate 302 opposite an area of heater member 208 that does not contact A4 sized media but contacts Letter sized media. In the example shown, line E1 corresponds a location in fuser nip N which the non-reference edge of A4 media contacts when passing through fuser nip N while line E2 corresponds to a location in fuser nip N which the non-reference edge of Letter media contacts when passing through fuser nip N and which is not contacted by the non-reference edge of A4 media when passing through fuser nip N. Edge thermistor 318 is positioned at a location beyond line E1, such as between lines E1 and E2, and is used for sensing the temperature a substrate region beyond the non-reference edge of A4 sized media. In one example embodiment, edge thermistor 318 may be positioned about halfway between lines E1 and E2, such as about 3 mm from line E1. In the example embodiment or in another example embodiment, edge thermistor 318 is positioned between first thermistor 314 and second thermistor 316 relative to the process direction PD such that edge thermistor 318 is disposed at a substrate region that is not directly heated by resistive traces 304, 306 (i.e., between the substrate regions directly heated by resistive traces 304, 306). In this way, the temperature sensed by edge thermistor 318 is based on heat contributions from both resistive traces 304, 306 and thus varies with the temperature sensed by each of the first and second thermistors 304, 306. It will be appreciated that thermistors 314, 316 and 318 are superimposed on resistive traces 304, 306 in FIG. 3 for reasons of simplicity and clarity, and it is understood that the thermistors are disposed on a surface of heater member 208 opposite the surface along which resistive traces 304, 306 are disposed. By having thermistors disposed on substrate 302 in this way, resistive traces 304, 306 may be independently controlled so that heater member 208 achieves a more uniform temperature profile from nip entry to nip exit of fuser nip N.

Fuser control block 320 is coupled to the outputs of thermistors 314, 316 and 318 and controls power source 312, via switches 313*a*, 313*b*, to supply power to heater member 208 according to temperature feedback from thermistors 314, 316 and 318. In the example illustrated, fuser control block 320 utilizes a power control system including a first power control unit 323 and a second power control unit 335 to control the amount of power delivered to resistive traces 304, 306 for generating heat.

First power control unit 323 is coupled to thermistors 314, 316 and 318 and employs a control loop feedback mechanism to calculate a power level for each of resistive trace 304, 306 based upon a set-point temperature for each trace and temperatures sensed by thermistors 314, 316 and 318. In the example shown, first power control unit 323 includes a temperature control logic block 325 and a PID logic block 330. Temperature control logic block 325 generally provides temperature reference values for setting the set-point temperatures for resistive traces 304, 306 based at least on temperature feedback from first thermistor 314, second thermistor 316, and/or edge thermistor 318. The set-point temperatures are used in controlling the heat generated by one or more substrate regions of substrate 302 corresponding to the regions covered by resistive traces 304, 306 are heated. Based on the set-point temperatures from temperature control logic block 325 and temperature feedback from thermistors 314, 316, and 318, PID logic block 330 calculates a first power level $PC_{HPT}$ for high power trace 304 and a second power level $PC_{LPT}$ for low power trace 306. First calculated power level $PC_{HPT}$ indicates a heating power for maintaining the temperature of high power trace 304 at its corresponding set-point temperature and second calculated power level $PC_{LPT}$ indicates a heating power for maintaining the temperature of low power trace 306 at its corresponding set-point temperature. In one example, PID logic block 330 calculates the first and second power levels $PC_{HPT}$, $PC_{LPT}$ at every predetermined time interval, such as every 5 msec.

In an example embodiment, second power control unit 335 acts as a power manager than determines the actual heating power level to be delivered to resistive traces 304, 306 based on the power levels calculated by PID logic block 330 to achieve a desired balance of temperature control performance, flicker response, and harmonics response. Thus, instead of delivering the first and second power levels $PC_{HPT}$, $PC_{LPT}$ specified by PID logic block 330, second power control unit 335 decides the actual heating power level to be delivered to resistive traces 304, 306. In the example shown, second power control unit 335 is communicatively coupled to first power control unit 323 to receive the calculated first and second power levels $PC_{HPT}$, $PC_{LPT}$ therefrom. In turn, second power control unit 335 selects a first actual power level $PA_{HPT}$ for high power trace 304 based upon the first calculated power level $PC_{HPT}$ and selects a second actual power level $PA_{LPT}$ for low power trace 306 based upon the second calculated power level $PC_{LPT}$. In an example embodiment, the first and second actual power levels $PA_{HPT}$, $PA_{LPT}$ are selected from a stored plurality of predetermined actual power levels, as will be discussed in greater detail below. The first and second actual power levels $PA_{HPT}$, $PA_{LPT}$ are each used to control the current supplied by power source 312 to resistive traces 304, 306, respectively. In the example shown, current flowing through each resistive trace 304, 306 is regulated by independently controlling the switching of switches 313*a*, 313*b*. When switch 313*a* is closed, current flows through high power trace 304 via conductors 310*c* and 310*a*, and when switch 313*b* is closed, current flows through low power trace 306 via conductors 310*b* and 310*a*.

Figure 4:
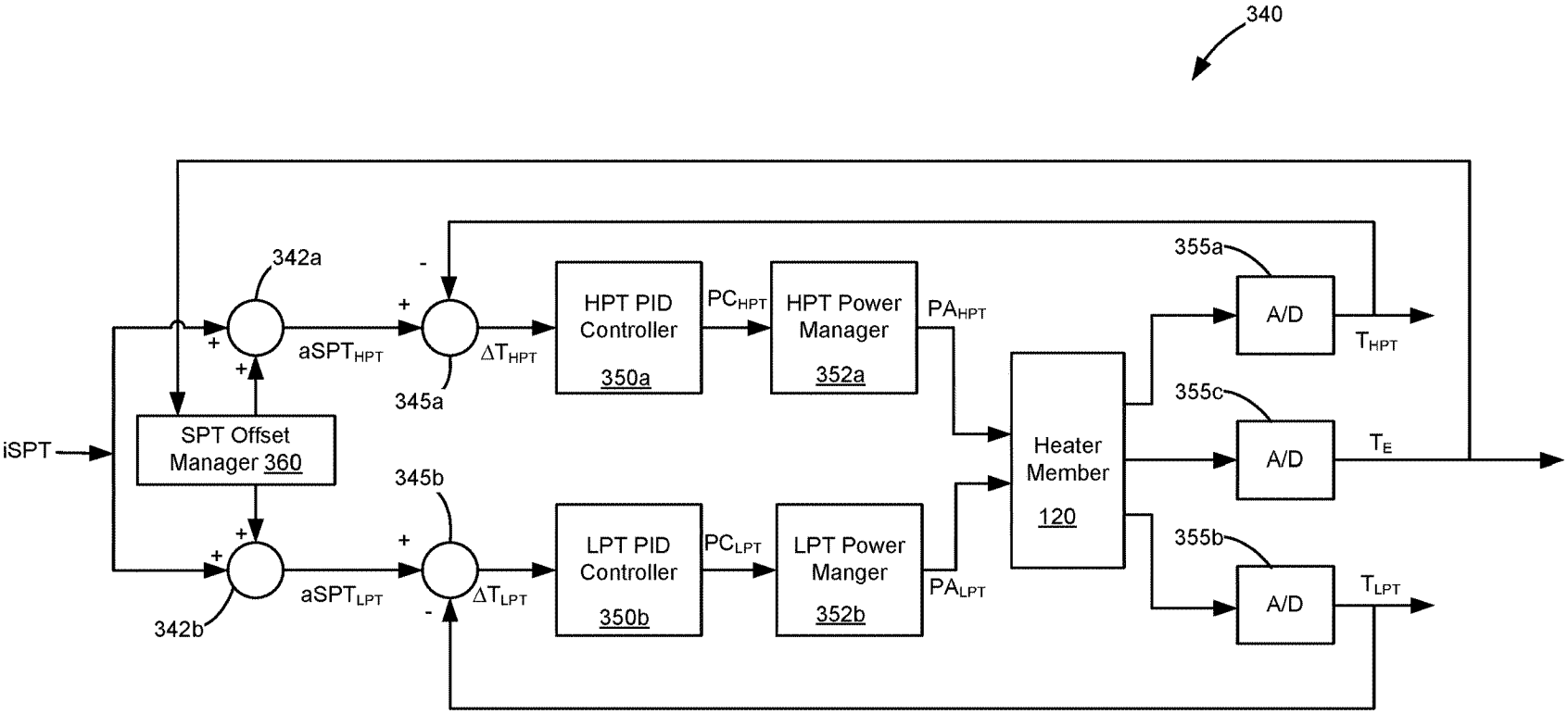
FIG. 4 illustrates a control system for controlling the heater member in FIG. 3 according to an example embodiment.

With reference to FIG. 4, a block diagram of an example form of a closed loop control system 340 that is used to control heater member 208 is shown. During a printing operation, a set-point temperature (SPT), which is provided by temperature control logic block 325, is set for each of high power trace 304 and low power trace 306 to generate an amount of heat for fusing media sheets. In one example embodiment, high power trace 304 and low power trace 306 may have the same initial set-point temperature iSPT, such as about 235° C. In an alternative example embodiment, high power trace 304 and low power trace 306 may have different initial set-point temperatures. The initial set-point temperature(s) iSPT may be determined based on media process speed and/or media type. In the example shown, initial set-point temperature iSPT is separated out and fed through nodes 342*a*, 342*b*, nodes 345*a*, 345*b* and into HPT PID controller 350*a* for high power trace 304 and LPT PID controller 350*b* for low power trace 306, respectively. PID controllers 350*a*, 350*b* are implemented in PID logic block 330 and are used to calculate power levels $PC_{LPT}$ and $PC_{LPT}$. The calculated power levels $PC_{HPT}$ and $PC_{LPT}$ outputted by PID controllers 350*a*, 350*b* are provided to HPT power manager 352*a* and LPT power manager 352*b*, respectively. Power managers 352*a*, 352*b* are implemented in second power control unit 335 and are used to select the actual power levels $PA_{HPT}$, $PA_{LPT}$ based on the calculated power levels $PC_{HPT}$ and $PC_{LPT}$, respectively. HPT power manager 352*a* outputs the selected actual power level $PA_{LPT}$ for high power trace 304 and LPT power manager 352*b* outputs the selected actual power level $PA_{LPT}$ for low power trace 306, which are then used to control heat generation in heater member 208, and more particularly the amount of heat generated by high power trace 304 and low power trace 306, respectively.

The actual edge temperature $T_E$ sensed by edge thermistor 318 in heater member 208 is received by a corresponding analog-to-digital (A/D) converter 355*c* and is fed to an SPT Offset Manager 360 implemented in temperature control logic block 325. SPT Offset Manager 360 uses the edge temperature $T_E$ sensed by edge thermistor 318 to make temperature adjustments for high power trace 304 and low power trace 306. In one example, SPT Offset Manager 360 outputs temperature offset values that are used to either increase or decrease the SPT values outputted by nodes 342*a*, 342*b*. In particular, each node 342*a*, 342*b* also receives as input the initial set-point temperature iSPT and outputs a corresponding adjusted set-point temperature aSPT for each of high power trace 304 and low power trace 306, respectively, based on the offset value provided by SPT Offset Manager 360. Controlling heater member 208 using SPT Offset Manager 360 is disclosed in more detail in U.S. patent application Ser. No. 15/222,138, filed Jul. 28, 2016, and assigned to the assignee of the present application, the content of which is incorporated by reference herein in its entirety.

The actual temperatures sensed by first (HPT) thermistor 314 and second (LPT) thermistor 316 are fed into respective A/D converters 355*a*, 355*b* which in turn feed the digitized values corresponding to sensed temperatures $T_{HPT}$, $T_{LPT}$ back to nodes 345*a*, 345*b*, respectively. Each node 345*a*, 345*b* also receives corresponding adjusted set-point temperature $aSPT_{HPT}$, $aSPT_{LPT}$ for high power trace 304 and low power trace 306, respectively. As set-point temperature adjustments are performed, each node 345*a*, 345*b* outputs a corresponding error signal $\Delta T$, e.g., $\Delta T_{HPT}$ or $\Delta T_{LPT}$, representing a difference between the detected sensed temperatures $T_{HPT}$, $T_{LPT}$ and the corresponding adjusted set-point temperature aSPT. PID controller 350*a* then calculates power level $PC_{HPT}$ based on error signal $\Delta T_{HPT}$ and PID controller 350*b* calculates power level $PC_{LPT}$ based on error signal $\Delta T_{LPT}$. Power Manager 352*a* receives the first calculated power level $PC_{HPT}$ independently selects first actual power level $PA_{LPT}$ based upon the first calculated power level $PC_{HPT}$. On the other hand, Power Manager 352*b* receives the second calculated power level $PC_{LPT}$ and independently selects the second actual power level $PA_{LPT}$ based upon the second calculated power level $PC_{LPT}$. HPT power manager 352*a* controls the powering of high power trace 304 using the selected first actual power level $PA_{LPT}$ and LPT power manager 352*b* controls the powering of low power trace 306 using the selected second actual power level $PA_{LPT}$.

In order to reduce, if not eliminate, the generation of harmonics in the power system, each predetermined actual power level is applied to a resistive trace using multiple AC half-cycle control. Specifically, at each AC half-cycle, a resistive trace is turned either fully-on or fully-off such that no intermediate power level therebetween may be delivered. Since only half or full cycles are used per AC cycle, switches 313*a*, 313*b* are turned on or off only during half-cycle boundaries corresponding to the zero crossings of the AC signal. By using multiple AC half-cycle control, second power control unit 335 delivers an average power over a group of AC half-cycles. The average power level that can be delivered over a group of AC half-cycles by multiple AC half-cycle control may depend on the number of AC half-cycles that is selected as a group. For example, if ten AC half cycles are selected as a group, multiple AC half-cycles control can deliver eleven discrete power levels: 0%, 10%, 20%, 30%, 40%, 50%, 60%, 70%, 80%, 90%, or 100%, by turning on 0, 1, 2, 3, 4, 5, 6, 7, 8, 9, or 10 AC half-cycles on, respectively. In this example, the smallest power level difference between two power levels is 10%.

The number of AC half-cycles that form a group delivering an average power may be selected to achieve a desired level of power control. For example, a group of half-cycles may be expanded to achieve finer power level control and consequently improve temperature control performance. However, when the number of AC half-cycles of a group is too large, temperature control performance may be compromised since heating power may be held constant for a relatively longer period of time which may not allow the heating power to be updated fast enough to respond to temperature changes during printing. Accordingly, the number of AC half-cycles that form a group for delivering a particular power level may be selected such that a desired level of fuser temperature control is achieved. In addition, the number of AC half-cycles may also be selected to achieve a desired balance between fuser temperature control and flicker performance.

Figure 5:
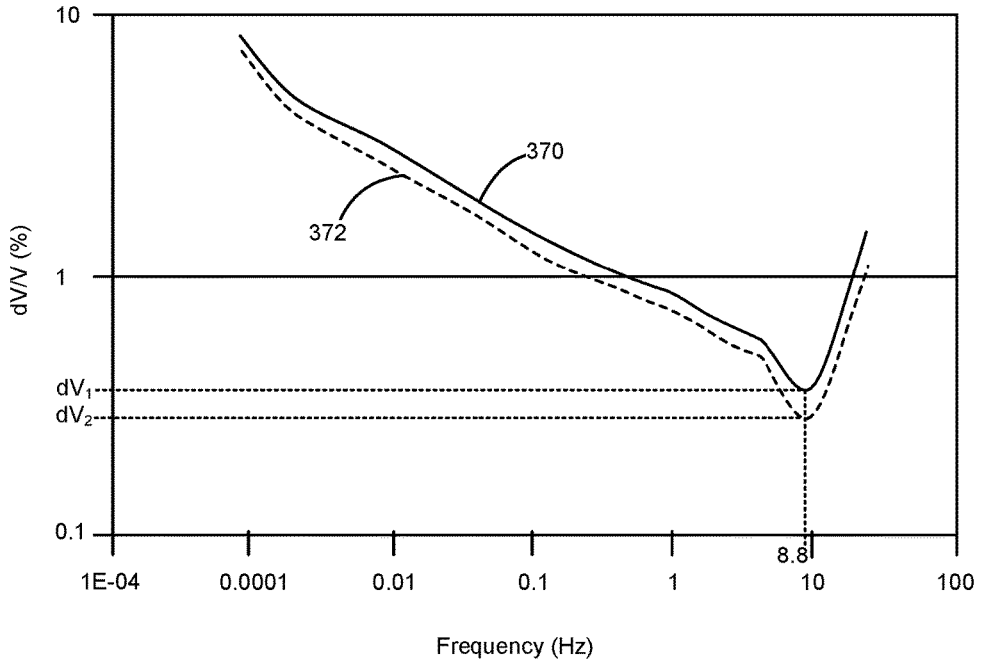
FIG. 5 illustrates an example flicker perceptibility curve.

FIG. 5 illustrates example flicker perceptibility curves showing percentage voltage variation for different frequencies. Flicker perceptibility depends on the frequency of voltage fluctuation or, in the case of using multiple AC half-cycle control, the AC half-cycle on/off frequency. In the example shown, curves 370 and 372 are $P_{st}$=1 curves, where $P_{st}$ is the short-term flicker perceptibility index. In this example, a value of 1.0 for the $P_{st}$ index represents the level at which flicker is seen as annoying by most observers. Below this $P_{st}$ level of 1.0, perceptible flicker may occur at times, but may be rare enough that is not annoying to most observers. Solid curve 370 is a $P_{st}$=1 curve for a 120 V, 60 Hz system while dashed curve 372 is a $P_{st}$=1 curve for a 230 V, 50 Hz system. Each point on curves 370, 372 corresponds to a $P_{st}$ level of 1. At frequencies near the peak sensitivity (at about 8.8 Hz) for each of curves 370 and 372, maximum sensitivity takes place in which even relatively small voltage variations (e.g., $dV_1$ and $dV_2$ which are less than 1%) can be perceived and result in noticeable flicker (or a $P_{st}$ level of 1). At frequencies higher or lower than the peak sensitivity, relatively larger voltage variations must occur before flicker can be perceived (or before a $P_{st}$ level of 1 is achieved). The half-cycle on/off switching frequencies around the peak sensitivity at about 8.8 Hz generate relatively more flicker while frequencies that are far away from 8.8 Hz generate relatively less flicker. In order to reduce flicker level, half-cycle waveform patterns which generate fewer flickers are used for powering resistive traces 304, 306.

In an example embodiment, each predetermined actual power level is associated with at least one half-cycle waveform pattern for powering at least one resistive trace. Example half-cycle waveform patterns for different predetermined actual power levels are illustrated in FIGS. 6A-6E. For example, second power control unit 335 selects a first predetermined half-cycle waveform pattern (associated with the first actual power level $PA_{HPT}$) to be used for powering high power trace 304 based upon the first calculated power level $PC_{LPT}$, and selects a second predetermined half-cycle waveform pattern (associated with the second actual power level $PA_{LPT}$) to be used for powering low power trace 306 based upon the second calculated power level $PC_{LPT}$.

In accordance with example embodiments of the present disclosure, five predetermined actual power levels are considered for powering each resistive trace 304, 306, namely 0%, 25%, 50%, 75%, and 100%. Each predetermined actual power level is associated with a pair of half-cycle waveform patterns, each half-cycle waveform pattern for powering one of high power trace 304 and low power trace 306. In the example waveform patterns illustrated in FIGS. 6A-6E, sixteen AC half-cycles are selected to form a group to deliver a desired average power level to a resistive trace. Having sixteen AC half-cycles provides a heating power updating period that is longer than the PID controller power calculation period. In particular, power managers 352*a*, 352*b* read the calculated power levels $PC_{HPT}$, $PC_{LPT}$ from PID controllers 350*a*, 350*b* only after the end of the sixteen AC half-cycles when it is time to select the next half-cycle waveform pattern. As such, heating power is maintained during the heating power period corresponding to the period of time the sixteen AC half-cycles of a waveform pattern is applied to a resistive trace. At the end of each heating power period, power managers 352*a*, 352*b* determine the next half-cycle waveform patterns based on the latest outputs of PID controllers 350*a*, 350*b*.

For each pair of waveform patterns associated with a predetermined actual power level, the upper waveform, hereinafter referred to as HPT waveform, is used for powering high power trace 304 and the lower waveform, hereinafter referred to as LPT waveform, is used for powering low power trace 306. In FIGS. 6A-6E, a half-cycle in dashed lines indicates an "off" state (i.e., the resistive trace is turned off) and a half-cycle in solid line indicates an "on" state (i.e., the resistive trace is turned on and/or otherwise powered to generate heat).

Figure 6A:
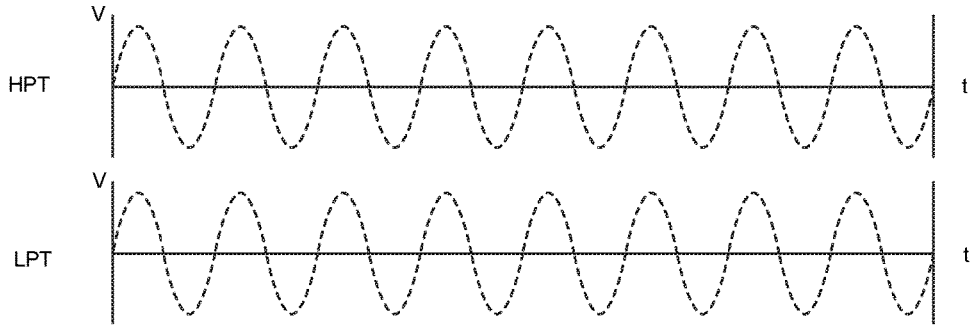
FIGS. 6A-6E illustrate different half-cycle waveform patterns for different power levels, according to an example embodiment.
Figure 6B:
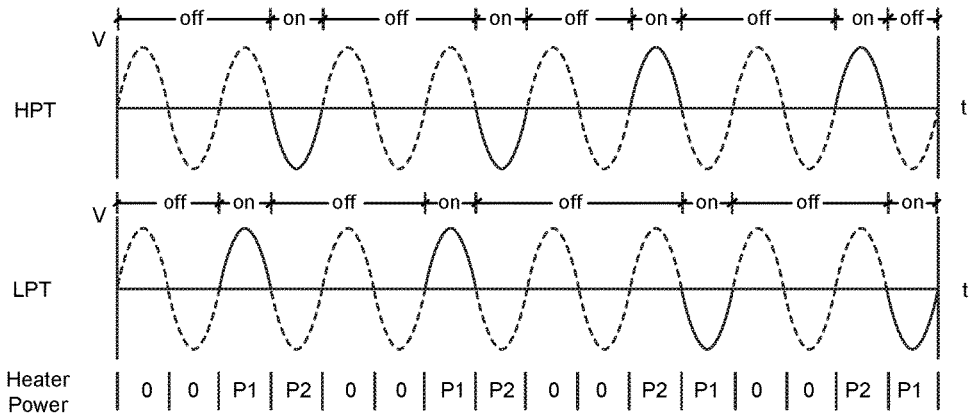
Figure 6C:
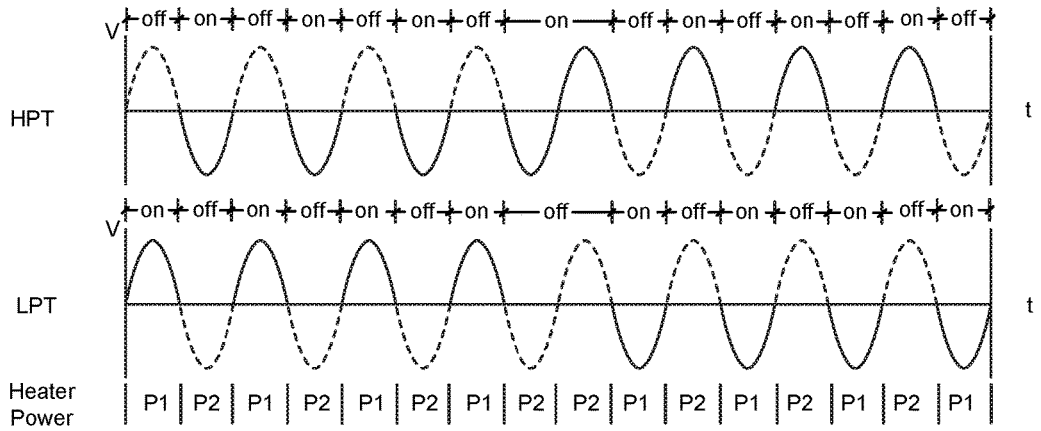
Figure 6D:
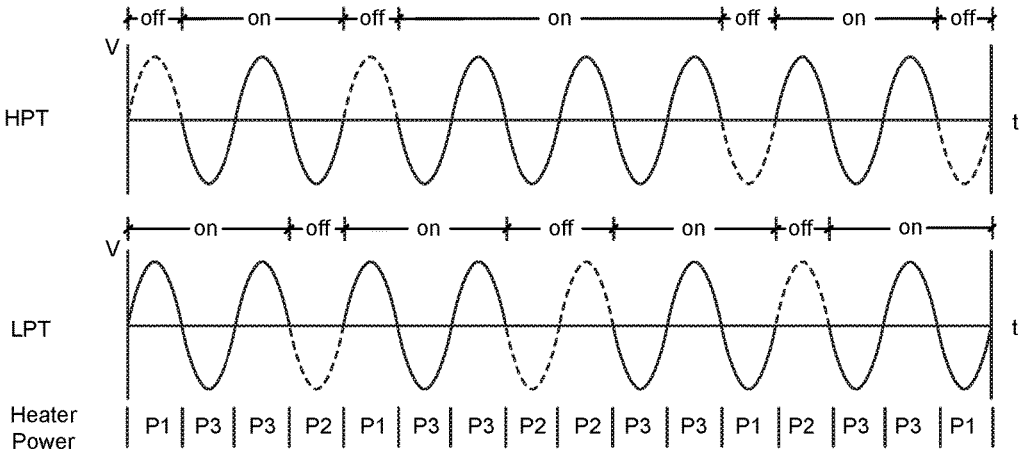
Figure 6E:
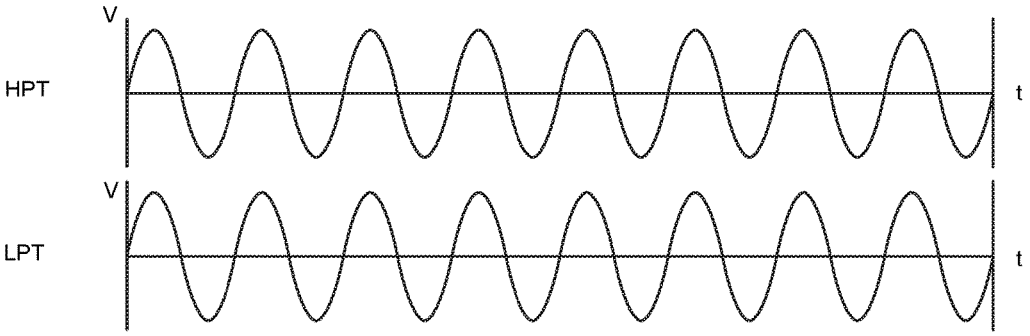

In FIG. 6A, all sixteen AC half-cycles of both HPT and LPT waveforms are turned off to achieve 0% actual power level in which no power is delivered to a resistive trace. In FIG. 6B, four AC half-cycles are turned on for each of the HPT waveform and LPT waveform to achieve 25% actual power level. In FIG. 6C, eight AC half-cycles are turned on for each of the HPT waveform and LPT waveform to achieve 50% actual power level. In FIG. 6D, twelve AC half-cycles are turned on for each of the HPT waveform and LPT waveform to achieve 75% actual power level. In FIG. 6E, all AC-half cycles are turned on for each of the HPT waveform and LPT waveform to achieve 100% actual power level.

Each half-cycle waveform pattern includes a first half portion comprising the first set of eight half-cycles and a second half portion comprising the second set of eight half-cycles immediately following the first set. In the example embodiment, for each half cycle waveform pattern, the first and second half portions are negative mirror images of each other with respect to a time at which the second half portion immediately follows the first half portion in order to avoid DC offset. For each pair of half-cycle waveform pattern associated with the same predetermined actual power level, the first half portion of the HPT waveform and the second half portion of the LPT waveform have the same signal pattern, and the second half portion of the HPT waveform and the first half portion of the LPT waveform have the same signal pattern. By defining the half-cycle waveform patterns in this way, the number of instances in which low power trace 306 and high-power trace 304 are both turned on or turned off in the same AC half-cycle is reduced or otherwise eliminated, which results in reduced heating power variations, voltage fluctuations and flicker.

Flicker generated during the sixteen AC half-cycles depend on the magnitude of power variations and the AC half-cycle on/off switching frequency, with those waveforms having higher power variation typically generating more sever flicker. In the example half-cycle waveform patterns illustrated, the particular half-cycles of the total sixteen AC half-cycles of a waveform that are turned on are chosen such that the half-cycle on/off switching frequency is relatively far from the peak sensitivity at 8.8 Hz identified in FIG. 5.

For each of the HPT and LPT waveforms associated with 0% and 100% actual power levels shown in FIGS. 6A and 6E, respectively, no flicker is generated during the sixteen AC half-cycles since power variation is zero.

For the HPT waveform associated with 25% actual power level shown in FIG. 6B, there are nine instances of on and off states during the sixteen AC half-cycles. With a 50 Hz AC source, the time duration of the sixteen half-cycles is 160 msec and the nine instances of on/off states within such time duration results in an AC half-cycle on/off frequency of about 56.25 Hz. With a 60 Hz AC source, the time duration of the sixteen half-cycles is 133.33 msec and the nine instances of on/off states within such time duration result in an AC half-cycle on/off frequency of about 67.5 Hz. For the LPT waveform associated with 25% actual power level for low power trace 306 shown in FIG. 6B, there are eight instances of on and off states during the sixteen AC half-cycles. With a 50 Hz AC source, the eight instances of on/off states within the 160 msec time duration result in an AC half-cycle on/off frequency of about 50 Hz. With a 60 Hz AC source, the eight instances of on/off states within the 133.33 msec time duration results in an AC half-cycle on/off frequency of about 60 Hz. The AC half-cycle on/off frequencies for the 50 Hz and 60 Hz systems of both HPT and LPT waveforms associated with 25% actual power level are relatively far from 8.8 Hz such that the amount of flicker is reduced. When both HPT and LPT waveforms are used for powering heater member 208, power variation is defined by four instances of heater member 208 being turned on from zero power (0 W) to non-zero power P1 or P2 (i.e., 500 W and 1000 W), four instances of heater member 208 being turned off from non-zero power P1 or P2 to zero power, and four instances of transitions between non-zero powers P1 and P2

For each of the HPT and LPT waveforms associated with 50% actual power level, high power trace 304 and low power trace 306 are alternately turned on and off to reduce the magnitude of heating power change during printing and reduce the chances of directly switching power from zero to 1000 W or from zero to 1500 W, and vice versa, which consequently reduces flicker. As shown in FIG. 6C, for example, power variation when both HPT and LPT waveforms are used for powering heater member 208 is defined by multiple instances of transitions between non-zero powers P1 and P2, with no transition between zero power and non-zero power and with no transition to/from non-zero power P3 (i.e., 1500 W), thereby reducing flicker. In addition, the waveform characteristics of each of the HPT and LPT waveforms associated with 50% actual power level provide fifteen instances of on and off states during the sixteen AC half-cycles. With a 50 Hz AC source, the fifteen instances of on/off states within the 160 msec time duration of the sixteen AC half-cycles result in an AC half-cycle on/off frequency of about 93.75 Hz. With a 60 Hz AC source, the fifteen instances of on/off states within the 133.33 msec time duration of the sixteen AC half-cycles result in an AC half-cycle on/off frequency of about 112.5 Hz. These on/off frequencies for the 50 Hz and 60 Hz systems of both HPT and LPT waveforms associated with 50% actual power level are relatively farther away from 8.8 Hz compared to that of the 25% actual power level such that the flicker level is reduced relative thereto.

For each of the HPT and LPT waveforms associated with 75% actual power level shown in FIG. 6D, there are seven instances of on and off states during the sixteen AC half-cycles. With a 50 Hz AC source, the seven instances of on/off states within the 160 msec time duration of the sixteen AC half-cycles result in an AC half-cycle on/off frequency of about 43.75 Hz. With a 60 Hz AC source, the seven instances of on/off states within the 133.33 msec time duration of the sixteen AC half-cycles result in an AC half-cycle on/off frequency of about 52.5 Hz. The 75% actual power level generates more flicker relative to that of the 50% actual power level because its HPT and LPT waveforms have half-cycle on/off frequencies that are closer to 8.8 Hz. In addition, power variation in the half-cycle waveform patterns for the 75% actual power level is greater than that of the 50% power level, which contributes to the generation of more flicker. As shown in FIG. 6D, for example, when both HPT and LPT waveforms are used for powering heater member 208, power variation is defined by multiple instances of transitions between non-zero powers P1, P2, and P3, with no transition between zero power and non-zero power.

Figure 7:
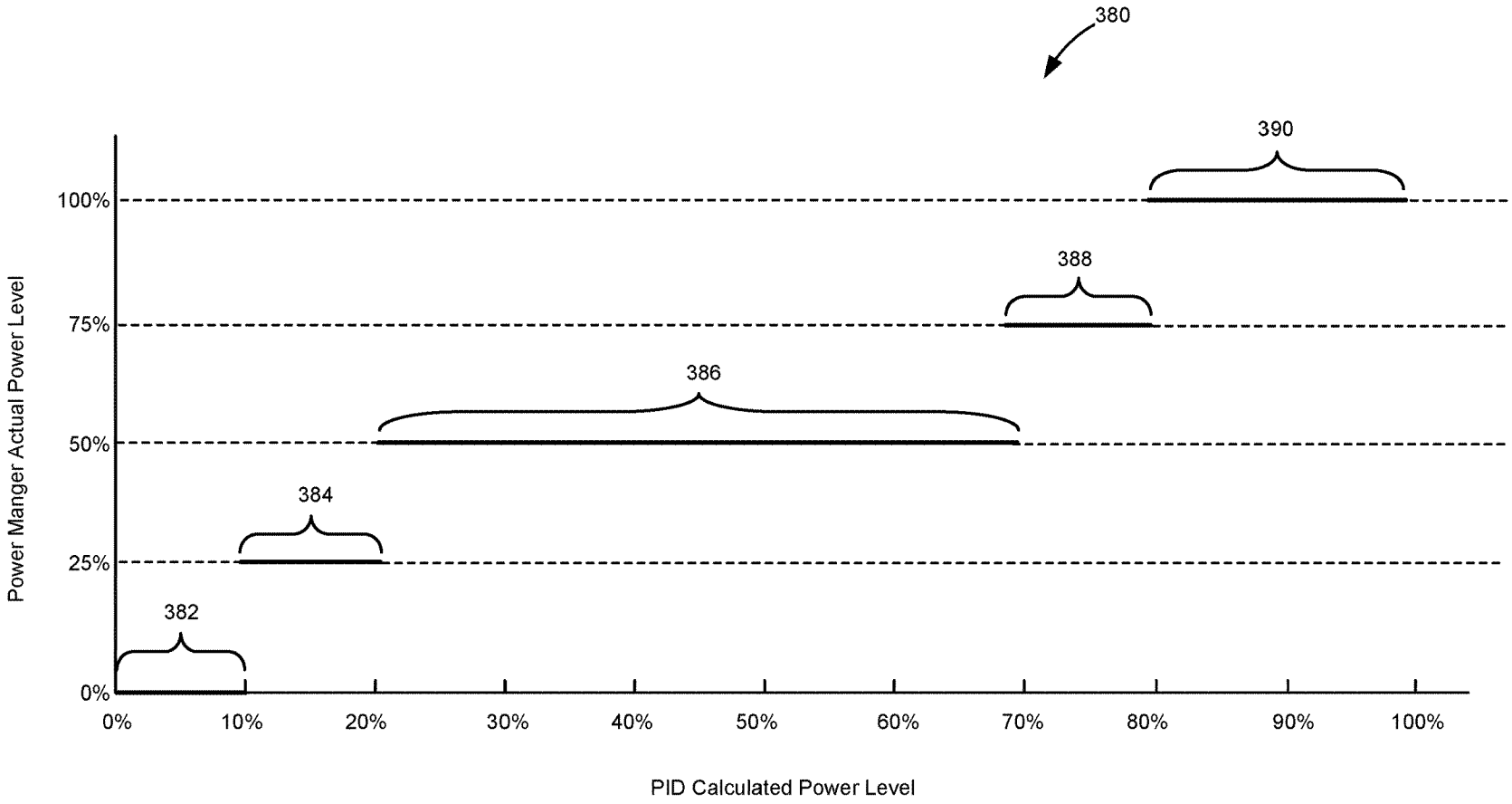
FIG. 7 is a chart illustrating weighted power mapping domains of different power levels, according to an example embodiment.

In order to reduce flicker level, fuser control block 320 is configured such that predetermined actual power levels that generate less flicker have a higher probability of being selected than predetermined actual power levels that generate more flicker. In an example embodiment, second power control unit 335 includes a power mapping function 337 that maps the calculated first and second power levels $PC_{HPT}$, $PC_{LPT}$ to the first and second actual power levels $PA_{HPT}$, $PA_{LPT}$. Power mapping function 337 defines a weighted mapping scheme in which one or more actual power levels have mapping domains that are larger than mapping domains of other actual power levels. FIG. 7 illustrates an example chart 380 showing different mapping domains of the five previously described actual power levels. As shown, 0% actual power levels are mapped to domain 382, while 50% and 100% actual power levels are provided with relatively larger mapping domains 386, 390, respectively, since they cause less flicker when used for powering a resistive trace. In the example shown, 50% actual power level has the largest mapping domain 386 to cover a wide range of power levels within which calculated power levels from PID controllers 350*a*, 350*a* would typically fall during normal fusing operations. On the other hand, 25% and 75% actual power levels are provided with smallest mapping domains 384, 388, respectively, since they generate more flicker when used for powering a resistive trace. Accordingly, the mapping domains 386, 390 of 50% and 100% actual power levels, respectively, are expanded while the mapping domains of 25% and 75% actual power levels are reduced such that 50% and 100% actual power levels each has a higher probability of being selected than 25% and 50% actual power levels during a fusing operation.

The power mapping scheme employed by second power control unit 335 is not limited to the examples illustrated above. For example, the mapping domains of each power level may be adjusted depending on temperature control and flicker requirements. As an example, 25% and 75% actual power levels may be removed by setting their respective mapping domains to zero if temperature control performance is acceptable. In other example embodiments, power managers 352*a*, 352*b* may have different power mappings for different resistive traces and different print speeds depending on temperature control and flicker requirements.

In operation, second power control unit 335 may access a lookup table, which includes a plurality of stored power levels and corresponding predetermined actual power levels associated therewith, to cross-reference the calculated power levels from PID controllers 350*a*, 350*b* for a stored power level correlated with a particular predetermined actual power level. The lookup table may be stored in memory 142 of imaging device 100. An example lookup table showing PID calculated power levels (in terms of percentage) and corresponding predetermined actual power levels (in percentage), is illustrated in Table 1. Entries in Table 1 correspond to the mapping domains illustrated in FIG. 7.

TABLE 1

| Power Mapping | |
|---|---|
| PID Calculated Power | Actual Power |
| 0%-9% | 0 |
| 10%-20% | 25% |
| 21%-70% | 50% |
| 71%-80% | 75% |
| 81%-100% | 100% |

As shown, Table 1 includes a plurality of table records. Each table record includes a power level range and a corresponding predetermined actual power level. The power level range corresponds to a set or range of power level values within which the calculated power levels from PID controllers 350*a*, 350*b* may fall, and the corresponding predetermined actual power level indicates the actual power level to be delivered to resistive traces 304, 306 in lieu of the power level calculated by PID controllers 350*a*, 350*b*. The predetermined actual power levels, in this example, include the five predetermined actual power levels previously described: 0%, 25%, 50%, 75%, and 100%. As an example, if a power level of about 25% is calculated by first power control unit 323, then an actual power level of 50% is selected and the corresponding waveform pattern therefor is used for powering a resistive trace instead of the calculated 25% power level. As a result, the lookup table in Table 1 provides a reference for determining actual power levels to be applied to each resistive trace using the calculated power levels from PID controllers 350*a*, 350*b*.

The number of table records including the different ranges of power levels and corresponding predetermined actual power levels are not limited to the examples illustrated above. For example, the lookup table may include more or fewer table records, and in other example embodiments may include a plurality of lookup tables including power mapping tables for different resistive traces and/or different print speeds. Second power control unit 335 may utilize a plurality of table address pointers for specifying which lookup table to access.

Figure 8:
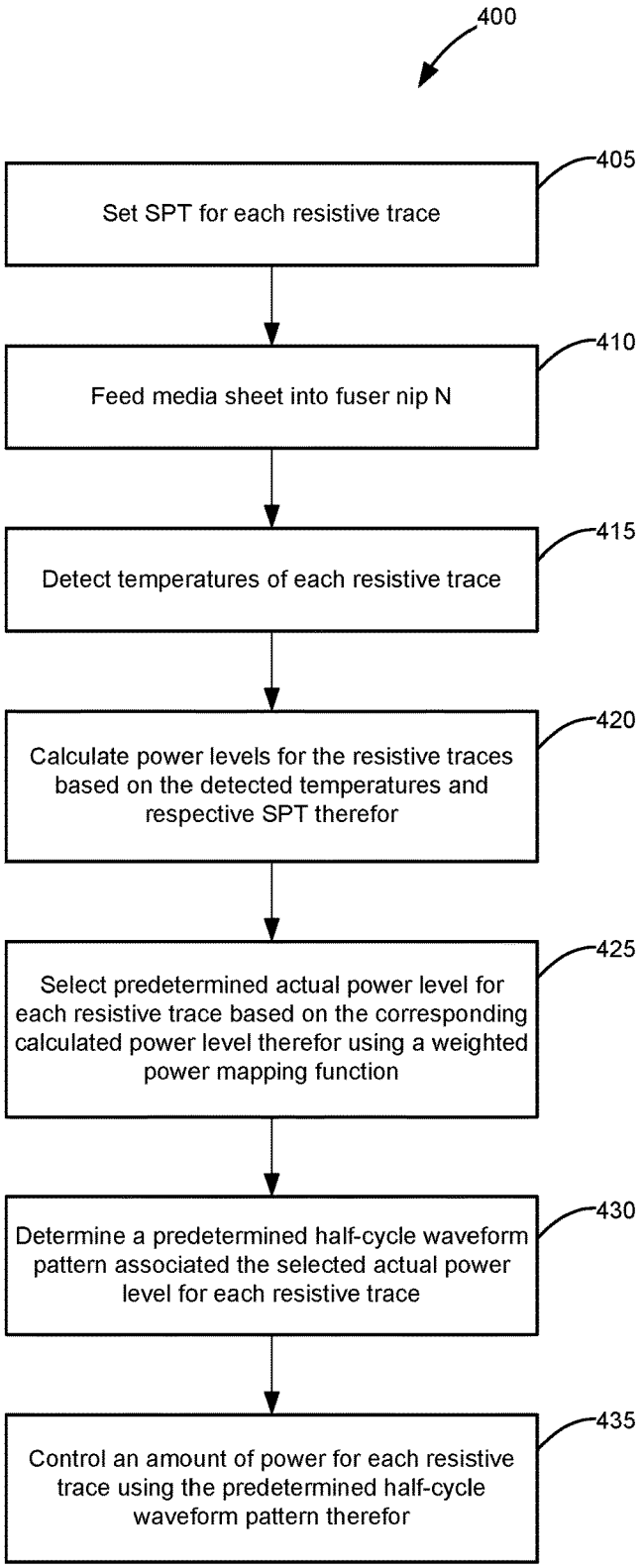
FIG. 8 is a flowchart of an example method for controlling the fuser assembly of FIG. 2 according to an example embodiment.

Referring now to FIG. 8, an example method 400 for controlling heater member 208 during a printing operation is illustrated according to an example embodiment. At block 405, initial set-point temperatures for high power trace 304 and low power trace 306 are set. Each of resistive traces 304, 306 generates an amount of heat based on its corresponding SPT. Media sheets pass through fuser nip N at block 410. As media sheets are fused, temperatures of the substrate regions covered by high power trace 304 and low power trace 306 are detected at block 415 using thermistors 314, 316, respectively. At block 420, first power control unit 323 calculates power levels $PC_{HPT}$ and $PC_{LPT}$ for high power trace 304 and low power trace 306, respectively, based on the detected temperatures and SPT therefor. Based on the first calculated power level $PC_{HPT}$, second power control unit 335 selects predetermined first actual power level $PA_{LPT}$ for high power trace 304, and based on the second calculated power level $PC_{LPT}$, second power control unit 335 selects predetermined second actual power level $PA_{LPT}$ for low power trace 306, at block 425, using power mapping function 337. For each selected actual power level, an associated predetermined half-cycle waveform pattern is determined at block 430. At block 435, the amount of power for each resistive trace is controlled using the predetermined half-cycle waveform pattern associated with the actual power level $PA_{HPT}$, $PA_{LPT}$ therefor.

The above example embodiments have been described with respect to a reference-edge media feed system where one side of the media sheet is in a substantially constant location within fuser assembly 120 regardless of the media width. It will be appreciated, however, that the concepts and applications described herein may also be used in center-referenced media feed systems where media sheets move at a center position along the media path and locations of both edges of the media sheet vary with media width. In addition, although illustrative examples have been described relative to using ceramic heaters having resistive traces as heating elements, it is understood that applications of the present disclosure extend to using other types of heaters, such as when using fuser lamps as heating elements.

The foregoing description of several example embodiments of the invention has been presented for purposes of illustration. It is not intended to be exhaustive or to limit the invention to the precise steps and/or forms disclosed, and obviously many modifications and variations are possible in light of the above teaching. It is intended that the scope of the invention be defined by the claims appended hereto.

What is claimed is:

1. An imaging device for fusing toner to media sheets in a process direction of media travel, the imaging device connectable to a supply of AC power, comprising:

first and second resistive traces of differing power sizes for heating; and a controller coupled to connect said each of the resistive traces to the AC power to selectively apply half-cycles of the AC power including calculating a power level from zero power (0%) to full power (100%) to cause the each of the resistive traces to maintain a predetermined set-point temperature, but not applying the calculated power level to the each of the resistive traces and mapping the calculated power level to one of only five actual heating power levels for application to the each of the resistive traces.

2. The imaging device of claim 1, wherein the one of only five actual heating power levels corresponds to sixteen consecutive half-cycles of AC power applied at zero-crossings thereof to individually turn on either of the resistive traces for 0%, 25% 50%, 75% or 100% of the sixteen consecutive half-cycles.

3. The imaging device of claim 2, wherein the controller is further configured to recalculate said power level in less time than a period of the half-cycles of the AC power.

4. The imaging device of claim 2, wherein the one of five actual heating power levels corresponding to said 25% of the sixteen consecutive half-cycles includes having four half-cycles turning on one of the first and second resistive traces.

5. The imaging device of claim 2, wherein the one of five actual heating power levels corresponding to said 50% of the sixteen consecutive half-cycles includes having eight half-cycles turning on one of the first and second resistive traces.

6. The imaging device of claim 2, wherein the one of five actual heating power levels corresponding to said 75% of the sixteen consecutive half-cycles includes having twelve half-cycles turning on one of the first and second resistive traces.

7. The imaging device of claim 2, wherein the one of five actual heating power levels corresponding to said 0% and 100% either fully turn on or off both the first and second resistive traces for all said sixteen consecutive half-cycles of AC power.

8. The imaging device of claim 1, wherein the first and second resistive traces have a length and width, the first resistive trace being longer and wider than the second resistive trace.

9. The imaging device of claim 8, wherein the first resistive trace is arranged first in the process direction followed by the second resistive trace in the process direction.

10. The imaging device of claim 1, wherein the first resistive trace has a larger rated heating power than the second resistive trace.

11. The imaging device of claim 1, wherein the controller includes proportional-integral-derivative (PID) logic to calculate the power level.

12. The imaging device of claim 1, further including three thermistors arranged about the first and second resistive traces and connected to provide a current temperature to the controller.

13. In an imaging device having a controller and a fuser assembly connectable to a supply of AC power, wherein the fuser assembly has a heater member and a backup member engaged to form a fusing nip having a nip entry and nip exit in a process direction of media travel and the heater member includes two resistive traces of differing power ratings extending transverse to the process direction, a method for powering the fuser assembly, comprising:

calculating a power level from zero power (0%) to full power (100%) to cause each of the resistive traces to heat or cool to a predetermined set-point temperature from a current temperature;

mapping the calculated power level to one of only five actual heating power levels according to a desired power flicker and harmonics response; and selectively applying the one of five actual heating power levels to said each of the resistive traces, wherein the actual heating power levels correspond to sixteen consecutive half-cycles of AC power in which the AC power is applied at zero-crossings thereof.

14. The method of claim 13, further including measuring the current temperature of said each of the resistive traces.

15. The method of claim 14, further including measuring again the current temperature of said each of the resistive traces for comparing to the set-point temperature.

16. The method of claim 13, further including receiving the set-point temperature of said each of the resistive traces.

17. The method of claim 16, wherein if the current temperature and the set-point temperature do not equal, calculating again a power level from zero power (0%) to full power (100%) to cause said each of the resistive traces to heat to the predetermined set-point temperature from a measured-again current temperature.

18. The method of claim 17, further including mapping again the calculated-again power level to the one of only five actual heating power levels.

19. The method of claim 13, further including recalculating the power level.

20. A fuser assembly for an imaging device to fuse toner to media sheets in a process direction of media travel, the fuser assembly connectable to a supply of AC power, comprising:

a heater member and a backup member engaged to form a fusing nip having a nip entry and nip exit in the process direction of media travel, the heater member having two resistive traces of differing power ratings; and a controller for selectively applying to each of the resistive traces consecutive half cycles of the AC power at zero-crossings thereof including calculating a power level from zero power (0%) to full power (100%) to cause said each of the resistive traces to heat to a predetermined set-point temperature from a measured current temperature but mapping the calculated power level to one of only five actual heating power levels whereby either of the resistive traces is turned on for 0%, 25%, 50%, 75%, or 100% of the consecutive half cycles.

* * * * *